United States Patent [19]

Salice

[11] Patent Number: 5,022,116

[45] Date of Patent: Jun. 11, 1991

[54] HINGE BRACKET ASSEMBLY

[75] Inventor: Luciano Salice, Carimate, Italy

[73] Assignee: Heidelberger Druckmaschinen AG, Heidelberg, Fed. Rep. of Germany

[21] Appl. No.: 365,569

[22] Filed: Jun. 14, 1989

[30] Foreign Application Priority Data

Jun. 29, 1988 [DE] Fed. Rep. of Germany ..... 3821946
Dec. 8, 1988 [DE] Fed. Rep. of Germany ..... 3841405

[51] Int. Cl.[5] ..... E05D 7/04
[52] U.S. Cl. ..... 16/258; 16/DIG. 43
[58] Field of Search ..... 16/236, 237, 249, 251, 16/DIG. 43, 258, 238

[56] References Cited

U.S. PATENT DOCUMENTS 4,620,343 11/1986 Grass ..... 16/236

FOREIGN PATENT DOCUMENTS 369101 12/1982 Australia .
0043903 1/1982 European Pat. Off. .
0225609 6/1987 European Pat. Off. .
0255692 2/1988 European Pat. Off. .
2657628 6/1978 Fed. Rep. of Germany .
3501048 7/1986 Fed. Rep. of Germany .
3605902 9/1987 Fed. Rep. of Germany .
2189837 11/1987 United Kingdom ..... 16/238

*Primary Examiner*—Richard K. Seidel
*Assistant Examiner*—Carmine Cuda
*Attorney, Agent, or Firm*—Herbert L. Lerner; Laurence A. Greenberg

[57] ABSTRACT

A hinge bracket assembly has a hinge bracket and a mounting plate for securing the bracket to a furniture part. The hinge bracket is either inserted into tracks of the mounting plate and is selectively clamped to the mounting plate by a fixing screw, which has been screwed into a tapped bore of the mounting plate, of the hinge bracket is resiliently locked to the mounting plate, which in that case is provided with a stop and with a resilient hooklike detent projection, which snaps behind a retaining edge portion of the hinge bracket or of an intermediate plate which is connected to the bracket. The mounting plate which is connected by a snap-action joint consists of a baseplate provided with tracks for an intermediate plate, which is longitudinally slidably mounted on the baseplate and is clamped together with the baseplate by a clamp screw. the clamp screw is screwed into the baseplate and extends through a slot of the intermediate plate. The intermediate plate is provided at its rear end with a spring-loaded detent lever, which is pivoted on a transverse axis and, at its forward end with pivot pins or with a fulcrum edge portion. The hinge bracket is hooked by means of a hook-like portion on the pivot pins or the fulcrum edge for pivotal movement to a position in which the hinge bracket is resiliently locked to the intermediate plate. In this position the detent lever engages and retains a part of the hinge bracket whereby the hinge bracket is fixed in position.

13 Claims, 2 Drawing Sheets

HINGE BRACKET ASSEMBLY

BACKGROUND OF THE INVENTION

1. Field of the Invention

This invention relates to a hinge bracket assembly comprising a hinge bracket and a mounting plate for securing the bracket to a furniture part or the like, wherein the hinge bracket either is inserted into tracks of the mounting plate and is adapted to be selectively clamped to the mounting plate by a fixing screw, which has been screwed into a tapped bore of the mounting plate, or the hinge bracket is resiliently locked to the mounting plate, which in that case is provided with a stop and with a resilient hooklike detent projection, which snaps behind a retaining edge portion of the hinge bracket or of an intermediate plate which is connected to said bracket.

2. Description of the Prior Art

European Patent Publication 255 692, the contents of which is expressly incorporated herein by reference discloses an assembly in which a hinge bracket is adjustable in the longitudinal direction of the mounting plate, i.e., in the direction of the depth of the furniture, if the hinge bracket is directly clamped together with the mounting plate by a fixing screw, which extends through a slot that is formed in the hinge bracket or the intermediate plate which is connected to the hinge bracket. But the known hinge bracket cannot be displaced on the mounting plate in the longitudinal direction and be fixed in position for an adjustment in the direction of the depth of the furniture if the hinge bracket is secured to the mounting plate by a snap-action joint.

SUMMARY OF THE INVENTION

It is an object of the invention to provide an assembly comprising a hinge bracket of the known type which can be clamped together with a conventional mounting plate by a fixing screw and can be resiliently locked to a mounting plate provided with snap-action connecting elements and which without a need for additional measures, can be adjusted in the longitudinal direction of the mounting plate, i.e., in the direction of the depth of the furniture, if the bracket is connected to the mounting plate by a snap-action joint. This means that a hinge bracket having a given design is to be provided which is adapted to be connected to the mounting plate in a selected manner and which independently of the manner in which the bracket is fixed can be adjusted in the direction of the depth of the furniture, and which bracket has a simple shape and can easily be manufactured.

In a hinge bracket assembly of the kind described, this object is accomplished in accordance with the invention, in that the mounting plate which is adapted to be connected by a snap-action joint consists of a baseplate, which is provided with tracks for an intermediate plate, longitudinally slidably mounted on the baseplate and is adapted to be clamped together with the baseplate by a clamp screw, which is adapted to be screwed into the baseplate and extends through a slot of the intermediate plate, said intermediate plate is provided at its rear end with a spring-loaded detent lever, which is pivoted on a transverse axis, the intermediate plate is provided at its forward end with pivot pins or with a fulcrum edge portion, the hinge bracket is hooked by means of a hooklike portion on the pivot pins or the fulcrum edge, for pivotal movement to a position in which the hinge bracket is resiliently locked to the intermediate plate, and in that position the detent lever engages and retains a part by which the hinge bracket is fixed in position.

A hinge bracket in accordance with the invention can either be clamped together with a baseplate by a fixing screw, or can be resiliently locked to the baseplate if the latter is provided with the required detent means. Each fixation of the hinge bracket may selectively be adapted without a need for special features or further adjusting means because the means for the adjustments in height and depth and the means for making the snap-action joint, if required, are provided on the baseplate.

The hinge bracket in accordance with the invention is adapted to be resiliently locked to the intermediate plate and the latter is guided on the baseplate in its longitudinal direction for an adjustment in depth and the hinge bracket is also adapted to be clamped together with the intermediate plate by a fixing screw. To permit unobstructed access to the fixing screw with a screwdriver, the web of the hinge bracket and the web of the intermediate plate which is optionally connected to said hinge bracket are provided each with a window-like slot.

The intermediate plate is suitably provided with an abutment for a stop part of the hinge bracket or of a further intermediate plate, which is connected to the hinge bracket. In an embodiment of the invention the abutment consists of projections, which are approximately trapezoidal in cross-section and are attached to the outside of the flanges of the intermediate plate, which is channel-shaped, and the stop parts consist of approximately mating recesses in the lower edge portions of the flanges of the hinge bracket, which is channel-shaped, or of the further intermediate plate which is connected to the hinge bracket.

In a preferred embodiment of the invention, the detent lever is provided with hooklike portions, which are laterally disposed and when resiliently locked to the intermediate plate extend behind and engage noselike extensions of the flanges of the hinge bracket or of the further intermediate plate, which is connected to said hinge bracket. The noselike extensions embrace the central portion of the spring-loaded lever approximately like a fork and are engaged by the hooklike lateral portions of the detent lever so that an effective anchoring is ensured. The noselike extensions have sloping bottom edges, which constitute wedge-shaped run-up ramps for the detent lever so that the latter will be swung back as the lever is pivotally moved to depress the hinge bracket and the detent lever finally snaps in behind the noselike extensions for a locking action.

The further intermediate plate may be pivotally connected to the hinge bracket for lateral adjustment (adjustment of the gap).

The hinge bracket may be adapted for adjustment in three dimensions, in that the baseplate is constituted by a bipartite assembly consisting of a bottom plate, which is adapted to be secured to a carrying wall or the like by fixing screws or plugs, and a cover plate which partly overlaps or entirely covers the bottom plate and is mounted on the bottom plate to be slidable transversely to the hinge bracket or the like.

The track for the intermediate plate may consist of an extension of the cover plate, which located centrally of the width of the cover plate at one end thereof, is narrower than the cover plate, and extends into a guide eyelet of the intermediate plate, which eyelet is constituted by legs, which extend from one end of the intermediate plate below the lower plane of the latter, and a crosspiece which connects the lower portions of said legs. The fixing screw which, for the fixation of the intermediate plate to the cover plate, extends through the slot in the cover plate is suitably disposed adjacent to the slot, preferably adjacent to a keylike enlarged portion of the slot, which is formed in the further intermediate plate that is connected to the hinge bracket.

DETAILED DESCRIPTION OF THE PREFERRED EMBODIMENT

Figure 1:
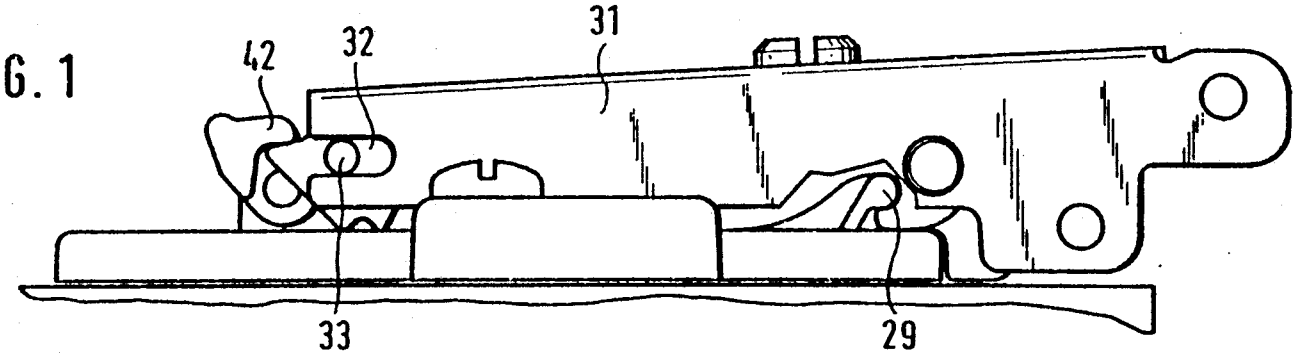
FIG. 1 is a side elevational view of a hinge bracket resiliently locked to a mounting plate.

An illustrated embodiment of the invention will now be explained in detail with reference to the drawing.

In general terms a baseplate 1 longitudinally slidably mounts a first intermediate plate 4, which is provided with detent means. A hinge bracket 2 is hinged to a further intermediate plate 3, which is adapted to be snapped onto the first intermediate plate 4.

The baseplate 1 consists of an assembly, comprising a bottom plate 5, which is cross-shaped in top plan view, and a cross-shaped cover plate 6, which entirely covers the bottom plate 5. The bottom plate 5 is disposed in a recess that is formed in the undersurface of the cover plate. An elongate central portion of the baseplate 1 is rectangular in cross-section and is sufficiently narrower than the central portion of the recess formed in the undersurface of the cover plate 6 to allow transverse slidability between the plates. The bottom plate has laterally extending arms which are also sufficiently shorter than corresponding recesses formed in the undersurfaces of arms 7, 8 of the cover plate such that the arms of the bottom plate are guided and transversely slidable in the recesses in the arms of the cover plate 6.

The narrow rear side of the central portion of the bottom base plate 5 is formed with an inwardly sloping beveled surface 9, which defines on the rear side a hook-shaped edge portion 10, and this extends into a complementary groove formed on the rear side of the recess in the undersurface of the cover plate 6. The groove is defined by a beveled surface 11, which is approximately parallel to the beveled surface 9.

Figure 2:
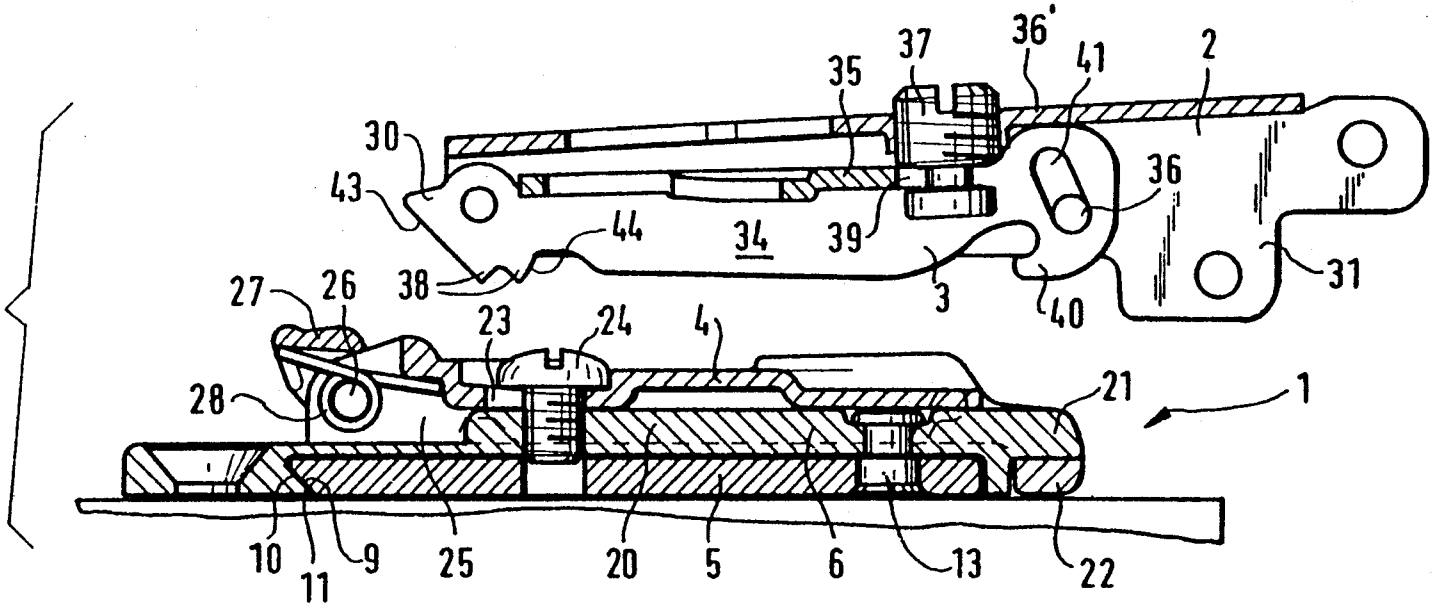
FIG. 2 is a longitudinal sectional view of the hinge bracket and the mounting plate with the hinge bracket lifted from the mounting plate.
Figure 3:
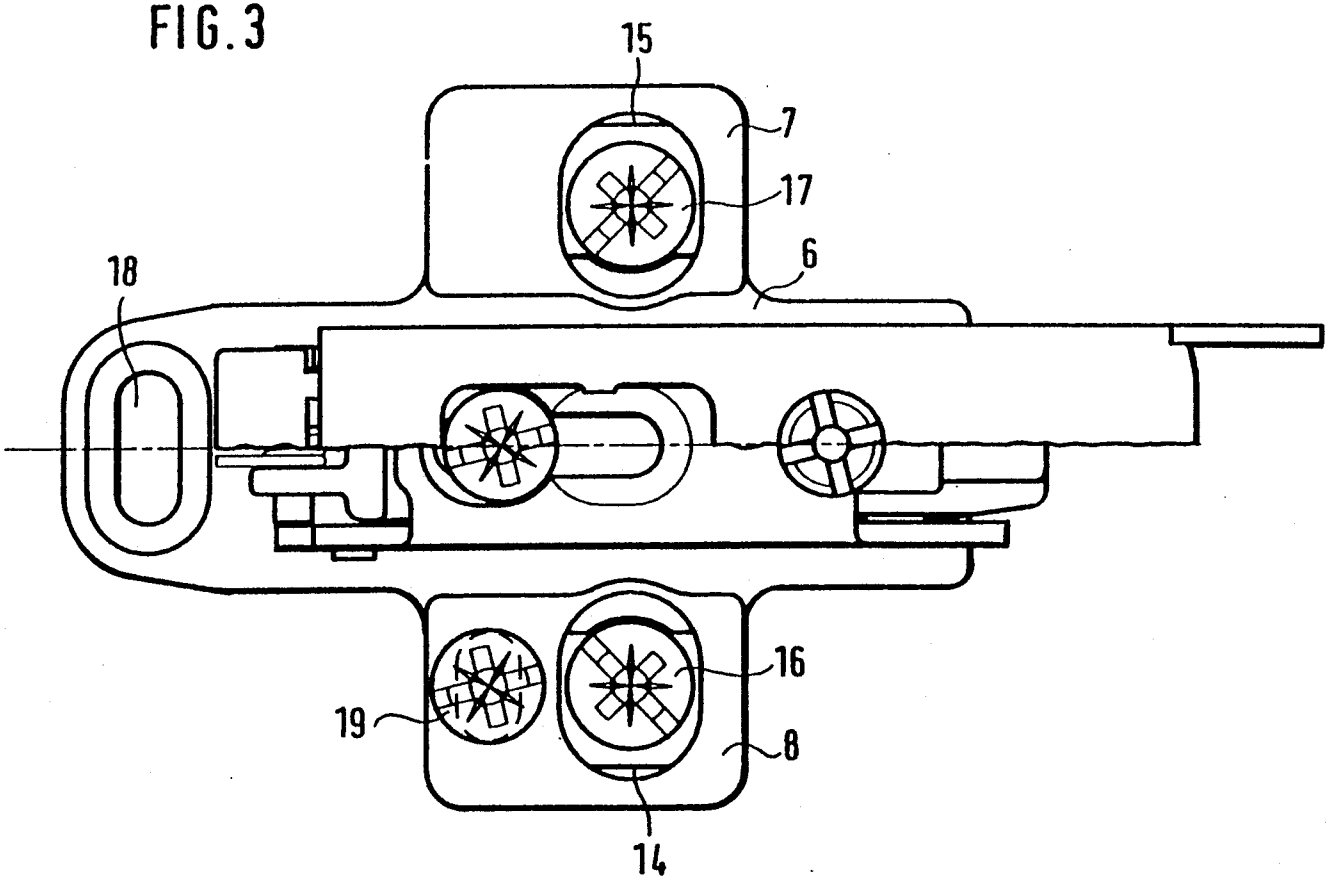
FIG. 3 is a top plan view of the assembly shown in FIG. 1.

On its end opposite the hook-shaped edge portion, the central portion of the bottom plate 5 is formed with a slot. A pin 13 extending through said slot is riveted to the cover plate 6, as is apparent from FIG. 2. The pin 13 is provided at its lower end with an enlarged head, the rim of which bears on the edge portion of the slot which is formed in the bottom plate 5.

The lateral arms of the bottom plate have tapped bores for receiving fixing screws. The bores are disposed adjacent to slots 14, 15, formed in the corresponding arms 7, 8 of the cover plate 6 and are wider than the heads 16, 17 of the fixing screws so that the latter can be passed through the cover plate 6 without obstruction when the fixing screws are to be screwed into the bores.

The cover plate 6 is provided at its front end with a transversely extending further slot 18, through which a further fixing screw for the cover plate may be passed when the screw is to be screwed into the baseplate 1.

To clamp the cover plate 6 and the bottom plate 5 against each other, one arm of the bottom plate is formed with a tapped bore, into which a fixing screw 19 is adapted to be screwed. The shank of screw 19 extends through a transversely extending slot that is formed in the arm 8 of the cover plate 6.

The cover plate 6 is formed in the central portion of its width with a pedestallike elevation or protuberance 20, which is approximately rectangular in cross-section and which extends beyond the forward end of the cover plate 6 to constitute an elongate guiding extension 21, which is approximately rectangular in cross-section. The pedestallike elevation 20 is formed in its rear portion with a tapped bore for receiving a fixing screw 24 for fixing the intermediate plate 4. The intermediate plate 4 is channel-shaped and its side flanges constitute edge portions which embrace the pedestal 20. In the forward portion of the intermediate plate 4 said edge portions are continued to extend also on the underside of the intermediate plate and the resulting legs are interconnected by a crosspiece 22 to form an eyelet or yoke. The intermediate plate 4 is formed in an intermediate portion of its width with a slot 23, through which the shank of the fixing screw 24 extends. A detent lever 27 is pivoted on pronglike legs 25 on the rear side of the intermediate plate 4 by means of a pin 26. Through a coil spring 28 having end legs, the lever is biased for a pivotal movement in the clockwise sense. The forward portion of the intermediate plate 4 is formed with lateral extensions 29, which protrude obliquely to the rear and have rounded ends. The intermediate plate 3 hinged to a hinge bracket 2, has hook-shaped portions, which are adapted to be hooked onto the extensions 29 so that the hinge bracket can be pivotally moved about the edge portions 29 and can thus be forced to a position in which it is resiliently locked to the intermediate plate 4 and in which the detent lever 27 extends over noselike abutment portions of the intermediate plate 3 and is retained thereon by a snap action. Inasmuch as the baseplate 1 and the intermediate plate 4, which is screw-connected to the baseplate 1, have been described hereinbefore they correspond to the tripartite baseplate assembly that is disclosed in German Patent Application P 38 20 389.8, which is not a prior publication to this application and to co-pending Canadian, Japanese, and U.S. patent applications which correspond to said German Application and the disclosure of which is incorporated herein by reference for further details.

The hinge bracket 2 consists of a sheet metal stamping, which has laterally disposed flanges 31, angled from the central web to form a channel. At its forward end, the hinge bracket 2 is provided with bores, which serve to receive pivot pins of any desired pivotal mountings such as for links of four-pivot hinges.

At the rear end of the hinge bracket 2, the flanges 31 are formed with slots 32, which are open at their rear end and receive the stamped pinlike projections 33 of the intermediate plate 3. The intermediate plate 3 consists also of a sheet metal stamping. The flanges 34 have been angled from the central web 35 to form a channel. The pinlike projections 33 are formed in the angled flanges 34. The flanges 34 have punched forward portions, which are formed with oblique slots 41, through which a pin 36 extends, which at its ends is riveted in bores of the flanges 31 of the hinge bracket 2.

The top portion of an adjusting screw 37 is screwed into a tapped bore in web 36 of the hinge bracket 2 and has a lower shank portion that is smaller in diameter than the top portion and is formed with an annular groove. As is apparent from FIG. 2 the annular groove is trapped in a slot 39, which is open-ended at the forward edge of the web 35 of the intermediate plate 3. As a result, the adjusting screw 37 can be rotated to impart to the hinge bracket 2 a pivotal movement relative to the intermediate plate 3. Owing to the oblique slots 41, the hinge bracket 2, during pivotal movement relative to the intermediate plate 3, also performs a translational motion, which compensates the change of the width of the gap formed between a wall and a door or the like of a cabinet or the like, which change is the result of lateral adjustment of the door or the like. As a result, the width of the gap between the door and the wall of a cabinet or the like will remain constant during lateral adjustment.

The rear end portions of the flanges 34 of the intermediate plate 3 are provided with depending teeth 38, which are intended to bite into a preferably grooved baseplate when the hinge bracket and baseplate are clamped by a fixing screw with the intermediate plate 3 interposed.

The flanges of the intermediate plate, 4 are provided on their outer sides with oblique ribs, which have enlarged rounded top portions 29.

The side flanges of the intermediate plate 3 are provided at their forward end with hookshaped portions 40, which can be hooked onto the rounded top portions 29 of the side ribs. The rounded top portions 29 of the intermediate plate 4 define a pivotal axis for the hinge bracket 2, which can be pivotally moved about the riblike edge portion 29 until the hooklike portions 42 of the detent lever 27 snap over the noselike extensions 30 of the intermediate plate 3. The noselike end portions 30 are provided on their underside with oblique edge portions 43, which are engageable by the detent lever 42 and adapted to force back the detent lever 42 until the hooklike portions snap over the noselike projections 30 for a locking action.

The flanges of the intermediate plate 3 are provided in their rear portions with trapezoidal recesses 44, which constitute stops for mating trapezoidal abutments provided on the outside surfaces of the flanges of the intermediate plate 4.

What I claimed is:

1. A hinge bracket assembly comprising a hinge bracket and a mounting plate for securing the bracket to a furniture part, the mounting plate including a baseplate and a first intermediate plate, the base plate being provided with a track for the intermediate plate for longitudinally slidably mounting the intermediate plate on the baseplate, a clamp screw which is screwed into the baseplate and extends through a slot in the intermediate plate to secure the plates together, the intermediate plate being provided at one end with a spring-loaded detent lever, which is pivoted on a transverse axis, the intermediate plate being provided at an opposite end with pivot means, the hinge bracket having a hooklike portion hooking same on the pivot means for pivotal movement to a position in which the hinge bracket is resiliently locked to the intermediate plate by engagement of the detent lever with an engaging part of the hinge bracket.

2. A hinge bracket assembly according to claim 1, wherein the mounting plate is provided with an abutment for a stop part of the hinge bracket and wherein the hinge bracket includes a second adjustable intermediate plate formed with said hooklike portion and said engaging part.

3. A hinge bracket assembly according to claim 2, wherein the second intermediate plate is pivotally connected to the hinge bracket for a lateral adjustment of a gap therebetween.

4. A hinge bracket assembly according to claim 2, wherein the abutment comprises projections, which are trapezoidal in cross-section and which are located on flanges of the first intermediate plate, which is channel-shaped, and wherein the stop parts consist of mating recesses in lower edge portions of flanges on the second intermediate plate, which is also channel-shaped.

5. A hinge bracket assembly according to claim 4, wherein the detent lever is provided with hooklike portions, which are laterally disposed and when resiliently locked to the hinge bracket extend over and engage said engaging part of the hinge bracket defined by noselike extensions of the flanges of said second intermediate plate.

6. A hinge bracket assembly according to claim 5, wherein the noselike extensions have sloping bottom edges, which constitute wedge-shaped run-up ramps for pressing back the detent lever.

7. A hinge bracket assembly according to claim 5, wherein the fixing screw for fixation of the intermediate plate to the cover plate extends through the slot in the cover plate disposed adjacent to a further slot which is formed in the further intermediate plate.

8. A hinge bracket assembly according to claim 7, wherein the further intermediate plate is provided adjacent the second slot with said noselike extensions.

9. A hinge bracket assembly according to claim 1, wherein the bottom plate is constituted by a bipartite assembly comprising a bottom plate and a cover plate, which at least partly covers the bottom plate and is transversely slidably mounted on the baseplate.

10. A hinge bracket assembly according to claim 9, wherein the bottom plate is provided at one end with an inwardly sloping beveled surface, which defines a hook-shaped edge portion extending into a mating groove defined by a parallel bevelled surface in the cover plate.

11. A hinge bracket assembly according to claim 9, wherein the cover plate and the bottom plate are interconnected by a fastener extending through a slot in one of the plates and fixed to the other plate.

12. A hinge bracket assembly according to claim 7, characterized in that the bottom plate is cross-shaped and is disposed in a conforming recess formed in the underside of the cover plate, which entirely covers the bottom plate, the width of an elongate central portion of the bottom plate and the length of respective lateral arms of the bottom plate and the length of respective lateral arms of the bottom plate being narrower and shorter, respectively, than corresponding portions of the recess in the cover plate such that the latter is transversely slidably guided on the bottom plate.

13. A hinge bracket assembly according to claim 1, wherein the track for the intermediate plate comprises an extension of the cover plate at one end thereof, said extension being narrower than the cover plate and extending into a guide eyelet of the intermediate plate, which eyelet is constituted by legs, which extend from one end of the intermediate plate and a crosspiece which connects lower portions of said legs.

* * * * *

UNITED STATES PATENT AND TRADEMARK OFFICE

CERTIFICATE OF CORRECTION

PATENT NO. : 5,022,116

DATED : June 11, 1991

INVENTOR(S) : Luciano Salice

It is certified that error appears in the above-identified patent and that said Letters Patent is hereby corrected as shown below:

On title page;

Item [73] should read "ARTURO SALICE S.p.A.
Novedrate (como) Italy"

Item [56] Attorney Agent or Firm should read

"FLEIT, JACOBSON, COHN, PRICE
HOLMAN & STERN"

Signed and Sealed this

Seventeenth Day of December, 1991

*Attest:*

HARRY F. MANBECK, JR.

*Attesting Officer*

*Commissioner of Patents and Trademarks*